US005330540A

United States Patent [19]

McBride et al.

[11] Patent Number: 5,330,540

[45] Date of Patent: Jul. 19, 1994

[54] METHOD OF DYEING TEXTILES

[75] Inventors: Daniel T. McBride, Chesnee; William M. Pascoe, Inman; John H. Belue, Spartanburg, all of S.C.

[73] Assignee: Milliken Research Corporation, Spartanburg, S.C.

[21] Appl. No.: 133,894

[22] Filed: Oct. 12, 1993

[51] Int. Cl.[5] ..... C09B 67/00

[52] U.S. Cl. ..... 8/554; 8/555; 8/557; 8/561; 8/654; 8/478; 8/479; 8/908

[58] Field of Search ..... 8/554, 552, 557, 650, 8/675, 922, 561, 654, 908, 478, 479

[56] References Cited

U.S. PATENT DOCUMENTS

| | | | |
|---|---|---|---|
| 3,929,697 | 12/1975 | Morrill et al. | 524/47 |
| 3,947,248 | 3/1976 | Powers | 8/551 X |
| 4,178,438 | 12/1979 | Haase et al. | 536/30 |
| 4,740,214 | 4/1988 | McBride et al. | 8/561 |
| 4,787,912 | 11/1988 | Abel et al. | 8/582 |
| 5,074,886 | 12/1991 | Fussmann et al. | 8/523 |

*Primary Examiner*—Arthur C. Prescott
*Attorney, Agent, or Firm*—Terry T. Moyer; James M. Robertson

[57] ABSTRACT

As a means for applying a random mottled or hammered appearance to a textile material, this invention provides a process which comprises the steps of: (a) applying to the textile material an aqueous solution having a water insoluble dye dispersed therein and an ionic component in the form of a dispersant in sufficient quantities to disperse the dye; (b) subsequently applying to the textile material an aqueous flocculent solution including a counter-ionic component, thereby electrochemically reacting with the ionic dispersant such that the dye is precipitated from solution in non-uniform concentrations; and (c) fixing the dye to the textile material, preferably by heat. A textile material dyed according to the process is also provided.

16 Claims, 1 Drawing Sheet

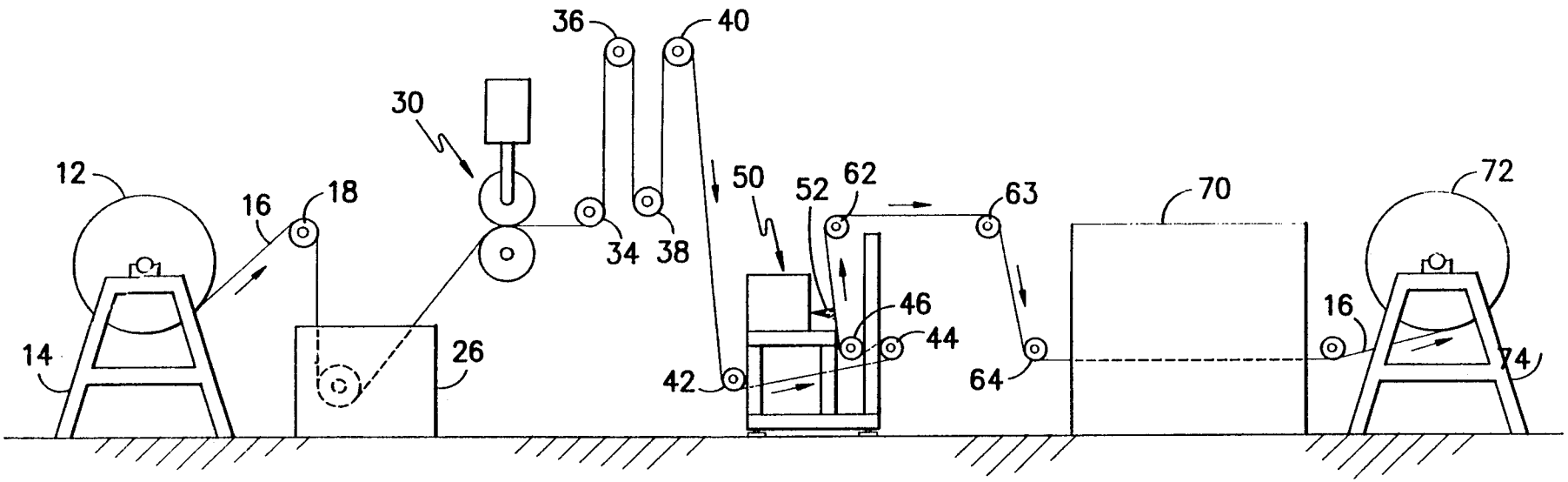
72
74
16
70
63
64
44
46
62
52
50
40
42
38
34
36
26
30
18
16
12
14

METHOD OF DYEING TEXTILES

FIELD OF THE INVENTION

This invention relates to a process for dyeing textile materials whereby a mottled or hammered appearance may be achieved. More particularly, in one aspect the invention relates to a process whereby a chemical interaction takes place between components of a dye solution and components of an oppositely charged solution applied after the dye solution to produce a reaction product giving rise to a textile material having an aesthetically pleasing appearance.

BACKGROUND

Use of pigment or dye dispersions to dye textile materials is well known. Typically the goal in such dyeing operations is to effect a uniform appearance across the surface of the material being dyed. Such uniform dyeing is addressed in detail in U.S. Pat. No. 3,929,697 to Morrill et al., entitled "Dye Composition And Method Of Dyeing", the teachings of which are incorporated herein by reference. In particular, the '697 patent to Morrill et al., discloses a dye composition comprising a water-insoluble pigment, a cationic flocculating agent and a dispersant with the possible addition of a binder resin to enhance crock-fastness.

In applications where uniform coloring has not been the desired outcome, the goal has typically been the impartation of a definite pattern to the textile material. U.S. Pat. No. 4,740,214 to McBride et al. (incorporated by reference) discloses a dyeing process wherein a textile material is printed in a manner such that an anionic component and a cationic component come into contact with one another when the dye solution is applied to the textile material. The ionic interaction which occurs during such contact forms a water-insoluble, dye impermeable skin around individual droplets to effectively control the undesired migration of the dye. This lack of dye migration permits greater precision in the ultimate pattern imparted to the textile material.

As disclosed in the '214 patent to McBride et al., the interaction of the cationic component with the anionic component may be accomplished by applying one of the components to the textile materials prior to application of the dye solution in the desired pattern and then applying the corresponding counter-ionic material as a component of the dye solution. Thus, according to the '214 patent, if the cationic component is first applied to the textile material as a component of an aqueous solution, the anionic component may be applied as a component of the dye solution. In like manner, if the anionic component is first applied to the textile material as a component of the aqueous solution, the cationic component may be applied as a component of the dye solution.

It can thus be seen that the prior art has recognized specific processes and practices to achieve uniform dyeing of textile materials as well as materials and processes for enhancing the pattern dyeing of textile materials through the ionic interaction of separately applied components. The present invention relates to a process for generating a mottled or hammered look on a textile material through the ionic interaction of a dye and a subsequently applied counter-ionic flocculation solution to generate a substantially random pattern across the surface of the textile material and thus represents a useful improvement over the present art.

SUMMARY

As a means for applying a random mottled or hammered appearance to a textile material, this invention provides a process which comprises the steps of: (a) applying to the textile material an aqueous solution having a water insoluble dye dispersed therein and an ionic component in the form of a dispersant in sufficient quantities to disperse the dye; (b) subsequently applying to the textile material an aqueous flocculent solution including a counter-ionic component, thereby electrochemically reacting with the ionic dispersant such that the dye is precipitated from solution in non-uniform concentrations; and (c) fixing the dye to the textile material, preferably by heat.

According to the invention one of the two aqueous solutions (dye solution or flocculent) applied to the textile material is cationic while the other is anionic. The cationic component and the anionic component desirably come into contact with one another after the dye solution is applied to the textile material.

As previously indicated, the electro-chemical interaction between the oppositely charged solutions (dye and flocculent) is believed to render ineffective the ionic dispersant, thereby bringing the dye out of solution while at the same time, the flocculating agent effects a degree of localized agglomeration of the dye particles at points across the surface of the material. This effects what appears to be a random distribution of dye concentrations across the surface of the textile material thereby imparting a mottled, hammered, three-dimensional appearance after the dye is fixed thereto. Such fixation is preferably achieved by means of heat. Such heat may be either in the form of dry heat applied in a tenter frame as is well known to those of skill in the art or in the form of wet heat transferred by means of superheated steam.

BRIEF DESCRIPTION OF THE DRAWING

The FIGURE is a schematic representation of an apparatus which may be employed in the process of the present invention.

While the invention will be described and disclosed in connection with certain preferred embodiments and procedures, it is not intended to limit the invention to those specific embodiments and procedures. Rather, it is intended to cover all such alternative embodiments and modifications as fall within the true spirit and scope of the invention as defined by the appended claims.

DESCRIPTION OF THE INVENTION

The present invention is useful for the impartation of a mottled, hammered, three-dimensional appearance to a broad range of fabrics including woven, knitted and non-woven textile materials. These textile materials may be constructed from natural and synthetic fiber including, by way of example, and not limitation, cotton, nylon, and polyester. The process of the present invention may be particularly suitable for polyester.

As indicated above, the process of the present invention includes the steps of applying an ionic dye solution and a counter-ionic flocculent solution. In a preferred practice, the initial step is to apply an aqueous solution of a desired dye to the textile material. The dyes preferred for such application are water insoluble dyes and may include disperse dyes, VAT dyes, direct dyes, and pigments. The term "dye" as used herein is thus intended to refer to all such materials although disperse dyes may be preferred.

The availability of appropriate dyes is almost limitless and may include the oxides, sulfides, and sulfates of naturally occurring inorganic materials such as cobalt, chromium, aluminum, iron, zinc, cadmium, manganese, and selenium as well as a broad range of organic materials. Organics may be preferred because of the wider availability of desired shades.

By way of example only, and not limitation, the following table lists representative disperse dyes and VAT dyes which may be used in the process of the present invention.

| Dye Name | C.I. Constitution Number |
|---|---|
| C.I. VAT Green 3 | 69501 |
| C.I. Disperse Yellow 42 | 10338 |
| C.I. Disperse Yellow 86 | — |
| C.I. Disperse Red 86 | 62175 |
| C.I. Disperse Blue 27 | 60767 |
| C.I. Disperse Blue 77 | 60766 |

It is to be understood that any number of other dyes may likewise be utilized as explained more fully below. A more detailed indication of the dyes which are available for use in the practice of the present invention is set out in the Colour Index, 3rd Edition, Society of Dyers and Colourists, Bradford, England, and American Association of Textile Chemists and Colourists, Research Triangle Park, N.C. (1992) Vol. 9, pp. 5069–5085 (disperse dyes); pp. 5187–5195 (VAT dyes). As will be appreciated, such listings represent an indication of the general classes of dyes which may be preferred but should in no way be construed as representing an exhaustive list of the dyes which may in fact be incorporated for use in the process of the present invention.

As will be appreciated by those skilled in the art, both disperse and VAT dyes as listed above are predominantly insoluble in water. Accordingly, in the preferred practice of the present invention, the dyes are dispersed by a dispersing agent such as is well known in the art. Anionic dispersants may be preferred.

Ordinarily, the dye is supplied as a paste which contains not only the dye colorant but also a dispersing agent such as described below. In some instances, the dispersant supplied in the paste may be sufficient to fully disperse the dye colorant, and no further dispersant needs to be added. The typical amount of dispersant in the dye concentrate ranges from about 0.01 percent to about 5 percent and preferably from about 0.1 percent to about 2 percent based on the weight of the concentrate. In many instances, however, it is desirable to add additional dispersant so as to supplement the amount of those which may already be present as supplied by the manufacturer. Any such additional dispersant is preferably of a nature to maintain the desired ionic character of the dye solution.

Suitable anionic dispersants include water-soluble salts having in their molecular structure an alkyl group containing from about 8 to about 20 carbon atoms and a sulfonic acid or sulfuric acid ester radical. Such dispersants include the sodium, potassium, and triethanolamine alkyl sulfates, especially those derived by sulfation of higher alcohols produced by reduction of tallow or coconut oil glycerides; sodium or potassium alkyl benzene sulfonates, in which the alkyl group contains from about 9 to about 15 carbon atoms, sodium alkyl glyceryl ether sulfonates, especially those ethers of higher alcohols obtained from tallow and coconut oil; sodium coconut oil fatty acid monoglyceride sulfates and sulfonates; sodium salts of sulfuric acid esters of the reaction product of one mole of a higher alcohol (i.e., tallow or coconut oil alcohols) and about 3 moles of ethylene oxide; and the water-soluble salts of condensation products of fatty acids with sarcosine, e.g., triethanolamine N-acyl sarcosinate, the acyl radicals being derived from coconut oil fatty acids.

Conventional soaps are also operable anionic surfactants for the purposes of this invention. Suitable soaps include the water-soluble salts, e.g., sodium, potassium, and lower alkanolamine salts of fatty acids derived from coconut oil, soybean oil, caster oil or tallow or synthetically produced fatty acids. These are operable, of course, only in relatively soft water, i.e., water which contains small proportions of calcium and magnesium.

Preferred anionic dispersants may include specifically, naphthalene sulfonate and lignin sulfonate.

It is to be appreciated that while anionic dispersants may be preferred, cationic dispersants may be utilized for later reaction with an anionic component. By way of example only and not limitation, suitable cationic dispersants may include: Polyethyleneamine; Poly(2-hydroxypropyl-1-N-methyl ammonium chloride); Poly(2-hydroxypropyl-1,1-N-dimethyl ammonium chloride); Poly[(N-dimethylaminomethyl) acrylamide], Poly(2-vinyl imidazolinum bisulfate); Poly(diallyldimethyl ammonium chloride); Poly(N,N-dimethylaminoethylmethacrylate) neutralized or quaternized; Poly[N-(dimethylaminopropylmethacrylamide)]; and Poly(-vinylamine).

In general, the dye solution which is to be applied to the textile material will contain one or more conventional dye stuffs including disperse dyes, VAT dyes, organic pigments and the like, depending upon the textile material to be dyed. Concentration of dye stuff in the aqueous dye solution may be in a range that is conventional for textile dyeing operations, e.g., about 0.01 percent to about 10 percent, preferably about 0.01 percent to about 2.5 percent by weight based upon the weight of the dye solution. Other conventional ingredients and additives may be provided in the dye solution such as acidic material, levellers, thickeners and defoaming agents as will be apparent to those skilled in the art.

In the preferred practice, the dye solution is applied to the textile material by a padding operation as is well known in the art. Typically in such a padding process the fabric is first saturated with dye solution, then passed between heavy rolls to squeeze out any excess solution. The dye solution is preferably added on at a level of between about 20 percent and about 200 percent, and preferably at about 40 percent to about 100 percent by weight based upon the weight of the textile material. It is to be understood that padding represents just one potential method of dye application and that the dye solution may be applied in any alternative fashion known to one of skill in the art. The dye baths prepared from the dyestuff concentrates are more effective if they are slightly acid, although a pH range of about 1.0 to about 9.0 is suitable. Preferably, the pH of the dye bath is within the range of from about 4.0 to about 5.0. The temperature of the dye bath may range from about 60° F. to about 212° F.

In the preferred practice of the present invention, after the dye solution is applied to the textile material, an aqueous flocculent solution is applied to the textile material with such application preferably to discrete portions on one side of the fabric. In practice, the flocculent solution will be applied over less than 100% of the dyed fabric surface area and preferably between about 10% and 50% of the dyed fabric surface area.

The aqueous flocculent solution applied to the dyed fabric includes a component which is counter-ionic with respect to the dye solution. Accordingly, if the preferred anionic dispersant is used in the dye solution as described above, the aqueous flocculent solution applied thereafter should include a cationic flocculating agent. The cationic flocculating agent may include a wide range of cationic, water-soluble organic materials having a nitrogen-containing cationic group, such as an ammonium group. Examples of preferred cationic materials include cationic polyacrylamide copolymers, e.g. polyacrylamide copolymers containing primary, secondary and tertiary amines, both quaternized and non-quaternized. A description of some generally applicable cationic flocculating agents is provided in the '697 patent to Morrill and the patents incorporated therein by reference.

A preferred cationic flocculating agent for use in the process of the present invention is available under the trade designation Calgon CA 260, a branched primary amine polymer which is available from Calgon Corporation, Pittsburgh, Pa. By way of example only, other cationic flocculating agents are available as Calgon 8863, a non-branched polymer with pendent primary amines, (formerly Hercules Hercofloc 863) available from Calgon Corporation, Pittsburgh, Pa.; Dodecylamine, a mono-primary amine; Millifix HDC 9207, a polymer with quaternary amine pendent groups available from Milliken & Company, Spartanburg, S.C.; and Cetyl Trimethyl ammonium chloride, a cationic quaternary surfactant. In instances where small veining is desirable, Millifix HDC 9207 may be preferred.

The cationic flocculating agent should be present in the aqueous flocculent solution at a level of between about 0.5 percent and about 10 percent and preferably at a level of between about 1 percent and about 5 percent by weight based upon the weight of the solution. The pH of the aqueous flocculent solution may be in the range of about 1 to about 9 and preferably in the range of from about 4 to 5.

It is to be appreciated that while cationic aqueous flocculent solutions are preferred due to the preferred use of anionic dye solutions, if the dye solution utilized is cationic, then the flocculent solution should be anionic to achieve the proper ionic interaction. Potential anionic components for use in the aqueous flocculent solution may include xanthan (an anionic polysaccaride), poly(sodium or ammonium acrylate), poly(-sodium styrene sulfonate), sulfonated lignon, sulfonated naphthalene derivatives, and sulfonated poly phenols.

Referring now to the drawing, a process and apparatus suitable for applying the dye and flocculent solution to the textile material is set forth. As illustrated, a supply roll 12 mounted on a support frame 14 contains a textile material 16. The textile material 16 may be advanced from the supply roll 12 as indicated by the solid line in the direction of the arrows. Specifically, the textile material 16 is advanced over a support roller 18 and into a pad bath 26. The textile material 16 is maintained in a substantially taunt condition throughout the process and is advanced from the pad bath 26 where an aqueous dye solution is applied, through a press roll 30, where excess liquid is removed. Thereafter, the textile material 16 may be passed over a plurality of support rollers 34, 36, 38, 40, 42, 44, and 46 to a fluid dispersal unit 50 which is preferably used to apply an aqueous flocculent solution 52 including a flocculating agent such as described above in a disperse fashion as droplets across the surface of the textile material 16 so as to precipitate the dye from solution at points across the surface. As previously indicated, the aqueous flocculent solution 52 should be counterionic to the aqueous dye solution.

It is to be appreciated that the fluid dispersal unit 50 may be of a number of different configurations. One configuration for the fluid dispersal unit 50 which may be preferred is a rotating roll and brush dispersal unit available from the Latanick Equipment Company of Huron, Ohio. Alternative configurations include atomization units based on rotating drums and disks which produce a fine misting of the applied liquid. One such atomization unit is the WEKO rotar damping system manufactured by Weirmann & Konrad GmbH & Co. KG of Leinfelden-Echterdingen (Germany). Tests run with such rotor damping units in which fluid application rates were varied between 100 and 1800 milliliters per minute indicated that best results may be achieved with such units at application rates of approximately 500 milliliters per minute. Still other potential configurations for the fluid dispersal unit include jet injection configurations comprising a plurality of gun bars each containing plural jets extending across the width of an endless conveyor, as well as simple spray headers and the like.

Once the aqueous flocculent solution 52 has been dispersed across the surface of the textile material 16, the textile material 16 can be fed across a series of support rollers 62, 63, 64, and then optionally into a fixation unit 70 which is maintained at a temperature sufficient to fix the dye applied to the textile material. The speed at which the textile material is passed through the fixation unit 70 can vary widely, with the only requirement being that the residence time of the textile material be sufficient to fix the dye. Such fixation may be effected by means of either wet or dry heating media. Wet steam may be preferred. From the fixation unit 70, the textile material 16 is advanced to a take-up roll 72 which is mounted on a suitable support 74. The take-up roll 72 may be a motor-driven take-up roll to insure advancement of the textile material through each of the treating steps set forth above.

The above sequence of steps and processes set forth schematically illustrate a preferred method for producing the improved product having a mottled, hammered, three-dimensional appearance in accordance with the subject invention. In order to more fully illustrate the concept of the subject invention the following examples are given. However, it is to be understood that such examples are not to be construed as unduly limiting the scope of the invention as set forth and defined in the appended claims.

EXAMPLE I

A 100% cotton, ring spun fabric having 66 ends per inch×38 picks per inch was treated by padding with a conventional forest green VAT dye (C.I. VAT Green 3 at 10 g/l) at about 80% based on the weight of the substrate. The wet substrate was then topically treated with CA-260, a cationic high polymer from Calgon Corporation of Pittsburgh, Pa. The topical treatment, a controlled misting of the substrate was accomplished with the use of a rotating brush dispersal unit supplied by Latanick Equipment Company of Huron, Ohio. The rotational settings were 175 RPM for the brush roll and 50 RPM for the liquid roll to give a random in situ flocked pattern at about 80% surface coverage. The substrate was then dried at 350° F. to remove water. The substrate was then treated conventionally, i.e. with steam to fix the VAT dyes to the cotton substrate. The resulting finished fabric possessed a hammered, almost three-dimensional appearance.

EXAMPLE II

The procedure of Example I was repeated with the substitution of a 100% polyester knitted pile upholstery substrate. The substrate was padded with a conventional aqueous blue disperse dye recipe (CI Disperse Blue 27 at 7.103 g/l, acetic acid (87%) at 4.4 g/l, and xanthan thickener at 0.77 g/l). The dispersal unit settings were 175 RPM for the brush roll and 35 RPM for the liquid roll. About 40% surface coverage was obtained. The substrate was then conventionally dried at 350° F. to remove water. The dye was then set at a temperature of 380° F. for three minutes. The resulting finished fabric possessed a marbled pattern.

EXAMPLE III

The procedure of Example II was repeated in all respects except a woven pile substrate was used. The resulting finished fabric possessed a muted pattern as compared to the result of Example II.

EXAMPLE IV

A 100% knit polyester fabric having a warp of 27 wales per inch and a fill of 49 course per inch available as Style 3061 from Milliken & Company of Spartanburg, S.C. was pad dyed with a conventional disperse dye recipe at about 100% wet pick up based on the fabric. The dye recipe used was a mixture of common disperse dyes which are listed along with their respective concentrations in Table I below. A 3% solution of a branched cationic primary amine polymer available as Calgon CA 260 from Calgon Corporation, Pittsburgh, Pa. was then sprayed onto the wet fabric at about 5% wet pick up. The fabric was then dried and thermosoled to fix the dyes. In addition to the dyes at concentrations as listed in Table I below, the dye recipe contained acidic acid (87%) at a concentration of 4.4 grams per liter and xanthan thickener at 0.77 grams per liter. The dye concentrations listed in Table I includes the dispersants included in the dye pastes as purchased from the dye vendors.

TABLE I

| DYE | DYE CONCENTRATION |
|---|---|
| C.I. Disperse Yellow 42 | 3.866 grams per liter |
| C.I. Disperse Yellow 86 | 3.866 grams per liter |
| C.I. Disperse Red 86 | 3.259 grams per liter |
| C.I. Disperse Blue 27 | 7.103 grams per liter |
| C.I. Blue 77 | 6.428 grams per liter |

An aesthetically pleasing mottled, hammered, three-dimensional appearance was achieved.

EXAMPLE V

In this example, the procedure of example IV was repeated in all respects including the use of the respective dye components and additives except that the cationic material was changed. In each of the examples, a non branched polymer with pendent primary amines available under the trade designation Calgon 8863 from Calgon Corporation, Pittsburgh, Pa. (formerly available as Hercules Hercofloc 863) was sprayed, via a 3% solution onto the wet fabric at about 5% wet pick up. A result similar to that achieved in Example IV was obtained.

EXAMPLE VI

The procedure described with respect to example IV was repeated in all respects including the use of the respective dye components and additives except that the cationic material was changed to Dodecylamine, a mono-primary amine (cationic surfactant). The results obtained were similar to the results of Example IV with the exception that the treated area displayed a red cast.

EXAMPLE VII

The procedure of Example IV was repeated in all respects including the use of the respective dye components and additives except that the cationic material sprayed onto the wet fabric was changed. The cationic material used was Millifix HDC 9207, a polymer with quaternary amine pendant groups available from Milliken & Company, Spartanburg, S.C. The respective results were superior to those of Examples IV in the respect that the veining achieved was smaller.

EXAMPLE VIII

The procedure of Example IV was repeated in all respects including the use of the respective dye components and additives except that the cationic material sprayed onto the wet fabric was changed. In these examples a quaternary ammonium salt (cationic quaternary surfactant) was sprayed via a 3% solution onto the wet fabric at about 5% wet pick up. The results achieved were generally similar to the respective results of Examples IV but the cast was red.

EXAMPLE IX

The procedure of Example IV was repeated in all respects except that the cationic material was replaced with water. The fabric displayed a good result with droplets greater than one-eighth inch. However, the effect is only at the tips of the fabric pile.

EXAMPLE X

A 100% cotton fabric having 66 ends per inch by 38 picks per inch available as Style 5520 from Milliken & Company, Spartanburg, S.C. was first conventionally prepared for print and vat dyed to a golden color. The substrate was then topically treated with a salmon vat dye color. The topical treatment, a controlled misting of the substrate, was accomplished by use of a rotating brush dispersion apparatus supplied by Latanick Equipment Company, Huron, Ohio. The settings were 125 RPM for the brush roll and 30 RPM for the liquid roll to give a random overdye pattern at about 30% surface coverage. The substrate was then dried at 350° F. to remove water and to prevent the pattern from marking off upon subsequent rolling or plating. The substrate was then treated conventionally to fix the vat dyes to the cotton substrate. The resulting finished apparel fabric possessed a speckled look as opposed to a mottled, hammered appearance of Example I.

What is claimed is:

1. A process for dyeing a textile material comprising the steps of:

(a) applying a solution having an insoluble dye dispersed therein and an ionic dispersant in sufficient quantity to disperse said insoluble dye;

(b) subsequently applying a solution including a component counter-ionic to said ionic dispersant, thereby substantially neutralizing said ionic dispersant; and (c) heating said textile material to fix said insoluble dye.

2. The process of claim 1, wherein said ionic dispersant is anionic.

3. The process of claim 2, wherein said counter-ionic component is a cationic flocculent.

4. A process for dyeing a textile material comprising the steps of:

(a) applying a first aqueous solution having a water insoluble dye dispersed therein and an anionic dispersant;

(b) subsequently applying a second aqueous solution of a cationic component to counteract said anionic dispersant; and (c) heating said textile material to fix said dye to said textile material.

5. The process of claim 4, wherein during step (b) said dye is precipitated from solution at points across the surface of said textile material.

6. The process of claim 4, wherein said dye is a disperse dye.

7. The process of claim 4, wherein said dye is a VAT dye.

8. The process of claim 4, wherein said anionic dispersant is selected from the group consisting of lignin sulfonate and naphthalene sulfonate.

9. The process of claim 4, wherein said textile material is polyester.

10. The process of claim 4, wherein the cationic component comprises a branched cationic primary amine polymer.

11. The process of claim 4, wherein the cationic component comprises a non-branched polymer having pendent primary amines.

12. The process of claim 4, wherein in step (b) said aqueous solution of a cationic component is applied in disperse fashion across said textile material.

13. The process of claim 4, wherein the pH of said first and second aqueous solutions is less than seven.

14. The process of claim 4, wherein in step (a) said first aqueous solution is padded onto said textile material.

15. A textile material dyed according to the process of claim 1.

16. A textile material dyed according to the process of claim 4.

* * * * *